US006120336A

United States Patent [19]

Kawai et al.

[11] Patent Number: 6,120,336

[45] Date of Patent: Sep. 19, 2000

[54] DIVING FIN

[76] Inventors: Takashi Kawai, 2-28-203 Mansei-cho, Minami-Ku, Yokohama City, Kanagawa, Japan, 232-0032; Sanae Kiyota, 6-16-3 Kaminagaya, Konan-Ku, Yokohama City, Kanagawa, Japan, 233-0051

[21] Appl. No.: 09/201,683

[22] Filed: Nov. 30, 1998

[30] Foreign Application Priority Data

Dec. 8, 1997 [JP] Japan ..... 9-354221
Feb. 26, 1998 [JP] Japan ..... 10-062248

[51] Int. Cl.[7] ..... A63B 31/08
[52] U.S. Cl. ..... 441/64; 441/62
[58] Field of Search ..... 441/61–64

[56] References Cited

U.S. PATENT DOCUMENTS

| | | | |
|---|---|---|---|
| 3,422,470 | 1/1969 | Mares | 441/64 |
| 4,025,977 | 5/1977 | Cronin | 441/64 |
| 5,108,327 | 4/1992 | Klein | 441/62 |
| 5,292,272 | 3/1994 | Grim | 441/64 |

FOREIGN PATENT DOCUMENTS 2197796 6/1988 United Kingdom .
WO88/01523 3/1988 WIPO .

*Primary Examiner*—Jesus D. Sotelo

[57] ABSTRACT

A diving fin comprises a boot section and a fin section as separate parts which are held in an assembly by a supportive or hinge structure incorporated in the forefront of the boot section and a rear edge of the fin section. The hinge structure comprises an axle or shaft within axially aligned cylindrical sleeves with the shaft coupled to the fin section so that raising or lowering of the fin relative to the boot section is performed by manual manipulation of the fin section. A latch is incorporated in the hinge for detachably securing the fin both in a raised position relative to the boot section and in a lowered position projecting forwardly from the boot section. The latch comprises a fixed radial projection on the shaft engageable with slits formed in one of the sleeves. The slits comprise a circumferentially extending portion that at opposite ends has arcuately spaced apart axially oriented latch slit portions defining the two latched positions of the fin. The sleeve elements of the hinge have adjacent ends of adjoining pairs spaced apart to permit lateral shifting of the fin section into and out of the latch slits.

8 Claims, 12 Drawing Sheets

DIVING FIN

BACKGROUND OF THE INVENTION

The present invention relates to diving fins which are capable of obtaining propulsion by being attached to the diver's feet at the time of diving in the water.

The diver has to wear many equipments according to the conditions in the water (the seawater and the fresh water) at the time of his diving into the water. Especially to his feet, the diving fins are attached in most cases in order to reduce the load to his feet and to obtain more efficient propulsion in the water.

Conventionally, the diving fin of this kind consists of the boot section for foot attachment/detachment and the fin section incorporated in the forefront of this boot section, which are molded into one piece by use of rubber material in most cases.

And, the fin section is designed to extend outwardly in a horizontal manner from the afore-mentioned boot section's forefront, and is formed in the fan shape with less thickness than the boot section and gets bigger in width gradually toward its forefront end.

And, cut out between the boot section and the fin section are vent holes for water which go through the front to the reverse side of the diving fin.

However, in case of the diving fin of conventional type, because of its one-piece mold construction of the boot section and the fin section, such inconveniences as below described have to be experienced.

1) At the time the diver moves to dive into the water from the boat or from the shore with the diving fin attached to his foot, because the forefront of the fin section is long, he is liable to stumble on even a small obstacle and fall, or because the forefront of the fin section stands in the way, he is bound to meet with difficulties in walking even on a flat ground.

2) When the diver climbs aboard from the water, he usually uses the ladder installed in the boat, but is bound to meet with difficulties in stepping on the ladder in case he is with the diving fin on his foot, because the forefront of the fin section stands in the way. The driver, therefore, removes the diving fin from his feet in the water afar from the ladder first, and hands this diving fin over to someone aboard. And then he swims up to the ladder to get aboard. In performing such actions, he is bound to meet with difficulties in keeping his balance because of heavy equipments he wears (especially the oxygen cylinder).

SUMMARY OF THE INVENTION

The present invention is capable of eliminating such inconveniences as earlier mentioned. More specifically, this invention is intended for providing such diving fin as capable of putting the fin section in the horizontally extending position at the time of its use in the water, and putting this fin section in the upright position at the time of its use during the diver's walk aboard or on the ground. The positioning change-over can be made by one-touch operation.

The invention is intended for providing such diving fin as designed to reduce water resistance substantially at the time of its use, and to gain amazing propulsion in the water.

The present invention comprises a boot section for foot attachment or detachment and a separate fin section installed in the forefront of the boot section.

The afore-mentioned fin section is designed to turn toward the afore-mentioned boot section by means of a supportive structure which incorporates a fixation structure or latch means to fix the afore-mentioned fin section at the horizontal position extending toward the forefront of the afore-mentioned boot section, and also at the upright position toward the rear end side of this boot section.

The afore-mentioned supportive structure is incorporated in the forefront of the boot section as well as in the rear end of the fin section. This supportive structure comprises coaxial cylinders being placed in line in the direction of the afore-mentioned diving fin's width (transversely) and having some spacing in between the two, and an axle inserted into the cylinders to couple the afore-mentioned boot section with the afore-mentioned fin section.

On the other hand, the fixation or latch structure consists of cut-out slits going through the interior and the exterior of the cylinder, and a protrusion installed on the circumference of the afore-mentioned axle and positioned in the interior of the afore-mentioned slits. The afore-mentioned cut-out slits consist of a first cut-out slit to be coupled with the afore-mentioned protrusion at the time the afore-mentioned fin section is in the horizontal position as earlier mentioned, a second cut-out slit to be coupled with afore-mentioned protrusion at the time of the afore-mentioned fin section is in the upright position as earlier mentioned, and a third cut-out slit going through the first and the second slits.

The afore-mentioned first and second cut-out slits are made along the axle core of the afore-mentioned cylinder and afar in the direction of the cylinder circumference. On the other hand, the third cut-out slit is made along the circumference of the afore-mentioned cylinder and in between the first cut-out slit and the second cut-out one. And, the afore-mentioned first cut-out slit and second cut-out slit have a step section with cut-out slit made wider.

The afore-mentioned 1st and 2nd cut out slits are both at the same side extending toward the width of the afore-mentioned diving fin from the 3rd cut out slit or, alternatively, on opposite sides of the 3rd slit.

A part of the rear end of the afore-mentioned fin section is cut out to have the cut out hole going through the afore-mentioned fin section from its front to the rear. The cut out fin or flap is installed to couple with the cut out hole and this cut out fin is designed to turn toward the forefront side and the rear-end side of the afore-mentioned boot section.

In a further embodiment of this diving fin, the fin section cannot only turn into the upright position, but also toward the reverse side of the boot section, so that the following advantages can be produced.

When the diving fin is used with the fin section being turned toward its reverse side, the load to the diver's foot can be reduced at the time of this diving fin in the water as compared with the case of its use with its fin section put into the horizontal position.

The foot strength varies according to the diver's age and other physical conditions, so it is most advisable that the angle of the fin section can be simply set according to the individual requirement and wishes.

The invention is intended for providing such diving fin as designed to reduce the burden on the diver's foot and to enhance its expediency greatly.

In this further embodiment the fin section is designed to turn against the boot section by means of the supportive structure, and is also designed to be fixed by means of the fixation structure both at the position where the fin section stands upright against the back side of the boot section, and at the folded position where the fin section stays folded toward the reverse side of the boot section. At both of these two positions, the fin section is in the horizontal position extending toward the forefront of the afore-mentioned boot section.

The afore-mentioned folded position is set up by the designated angle increments against the afore-mentioned horizontal position. And, at each of the designated angle increments, the afore-mentioned fin section is fixed by means of the fixation structure.

The afore-mentioned fin section is fixed by means of the fixation structure at the designated angle increments at the upright position and the folded position set up by each designed angle increments against the horizontal position in the turning direction.

The afore-mentioned designated angle may be set up to 45 degrees as the maximum by 5-degree increments.

Both the fin section and the boot section are designed to be attachable or detachable in point of the construction.

Figure 1:
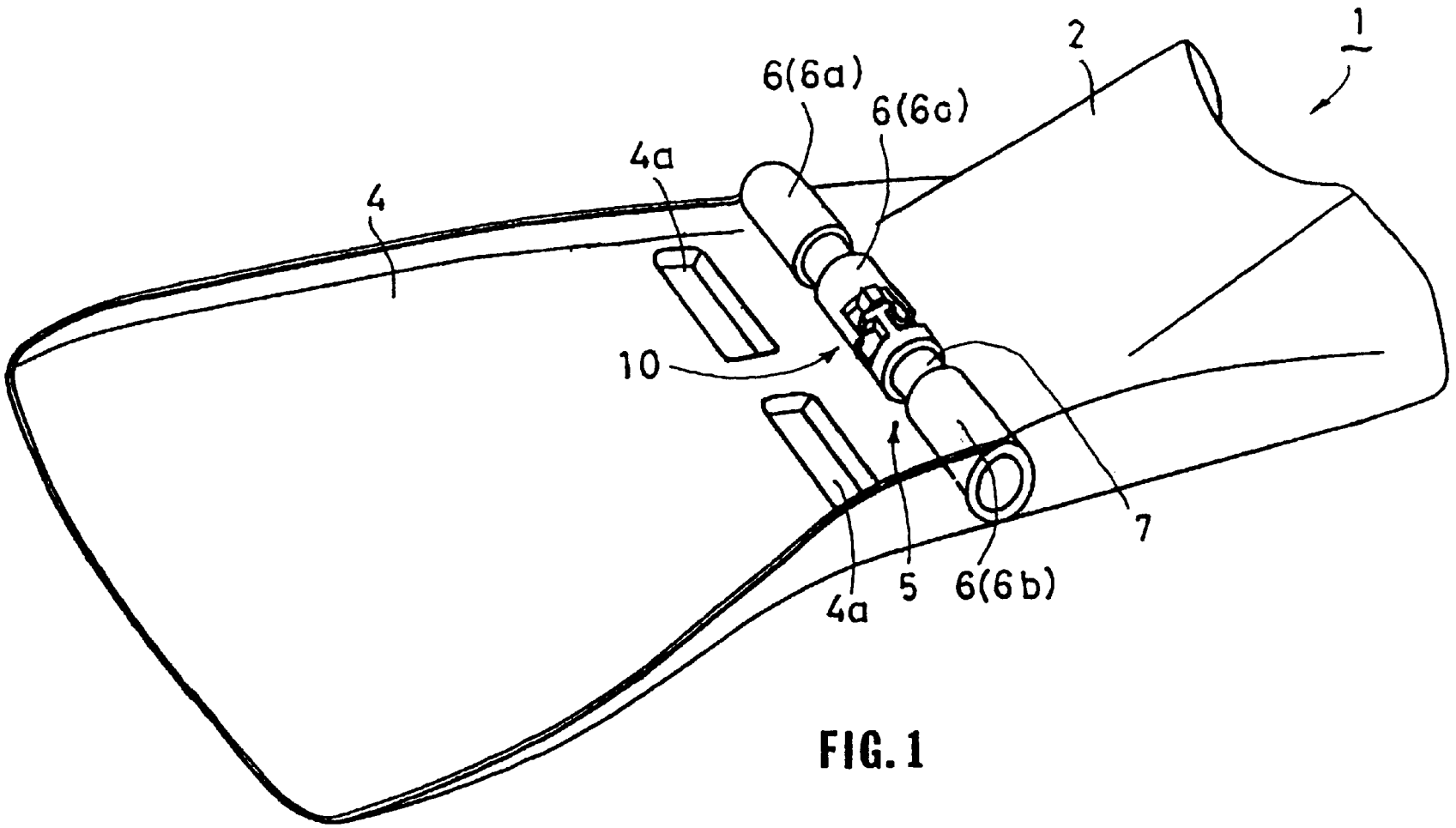
FIG. 1 is an oblique section of the diving fin detailed in a first embodiment of the invention in question.
Figure 2:
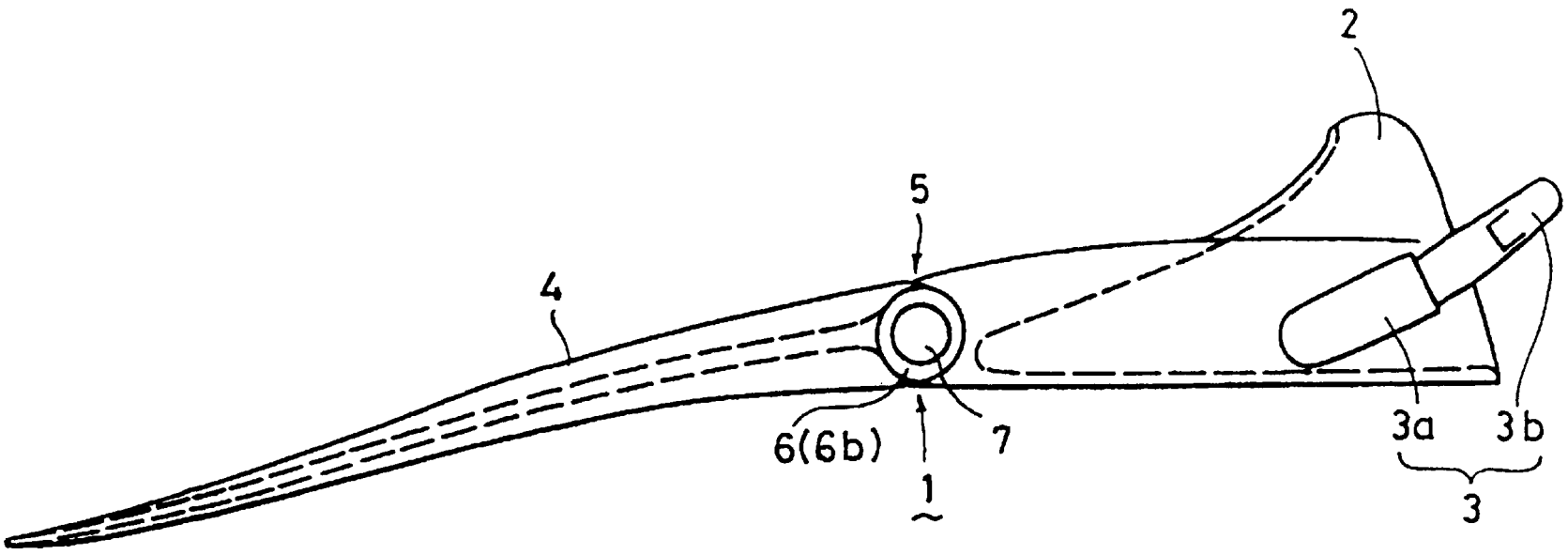
FIG. 2 is for a side view of the same diving fin.
Figure 3:
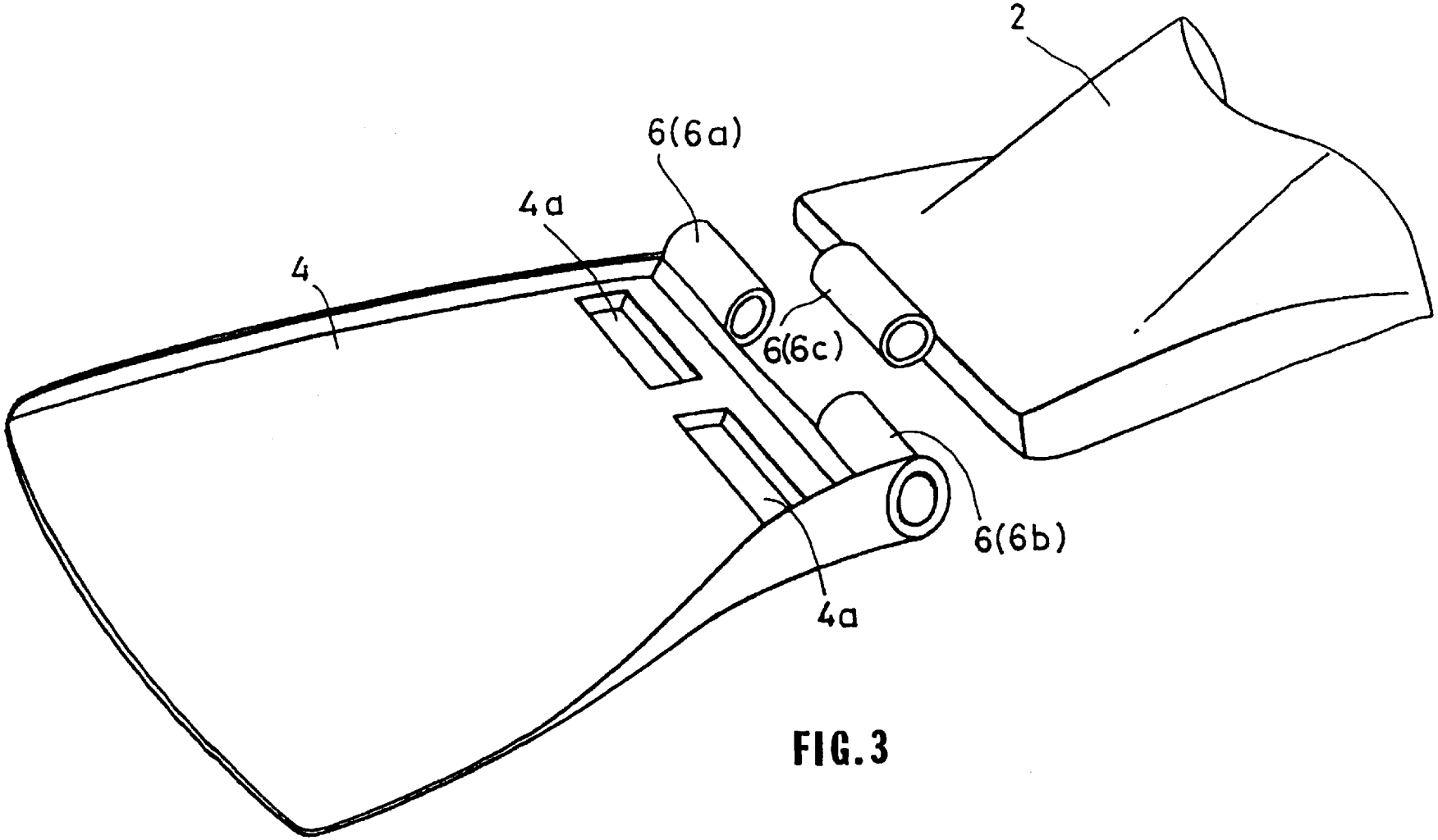
FIG. 3 is an exploded and oblique section of the same diving fin.

(a) of FIG. 5 is the drawing for a cross section of X—X line.

(b) of the same is the drawing for a cross section of Y—Y line.

(c) of the same is the drawing for a cross section of Z—Z line, and (d) of the same is the drawing for a cross section of W—W line.

Figure 6A:
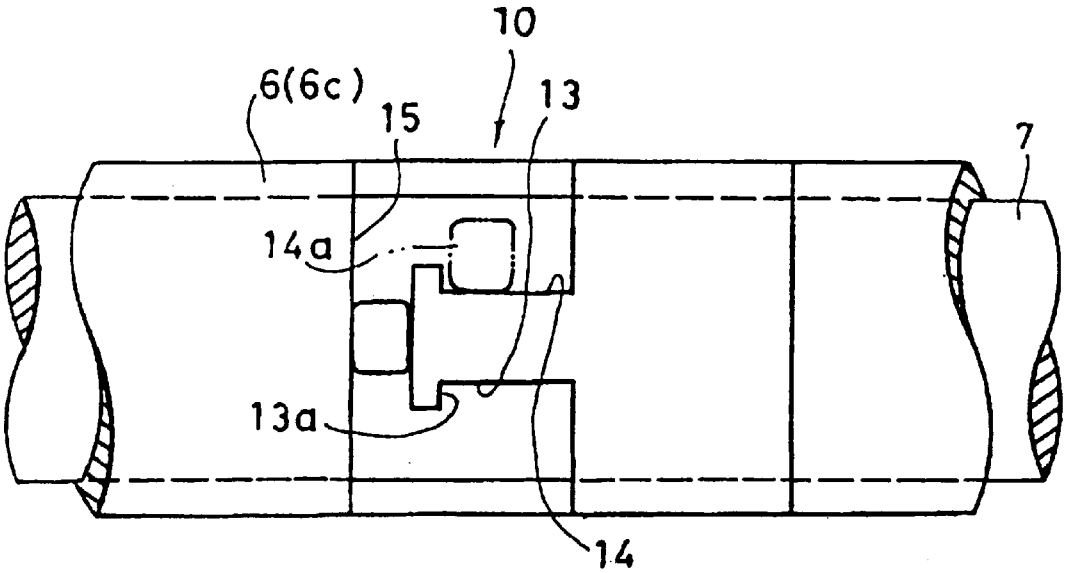
Figure 6B:
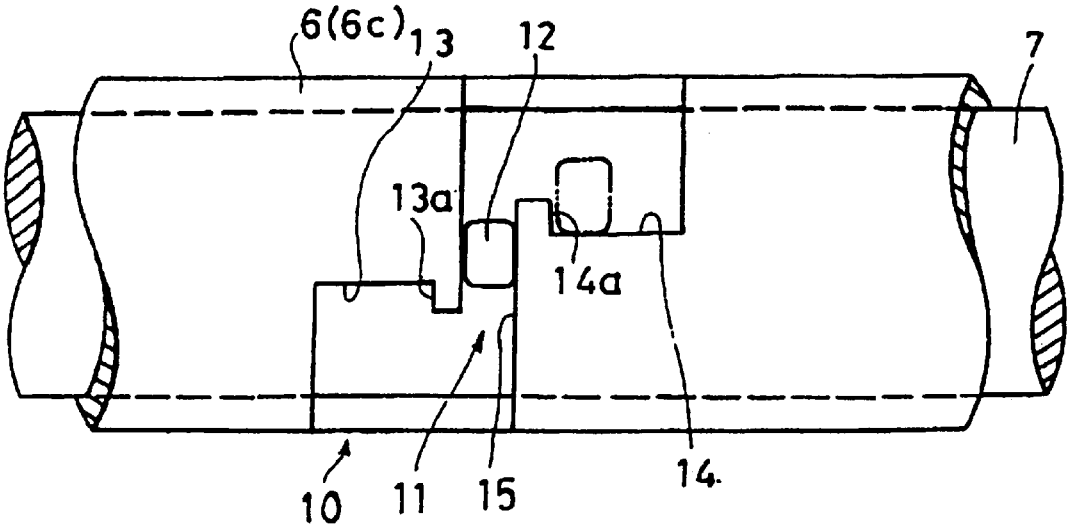

FIG. 6 shows details of the fixation structure of the diving fin.

(a) of FIG. 6 is the drawing for the cut out slit formed like the shape of sideward U, and (b) of FIG. 6 is the drawing for a plane figure for the cut out slit formed like the shape of the letter Z.

Figure 7:
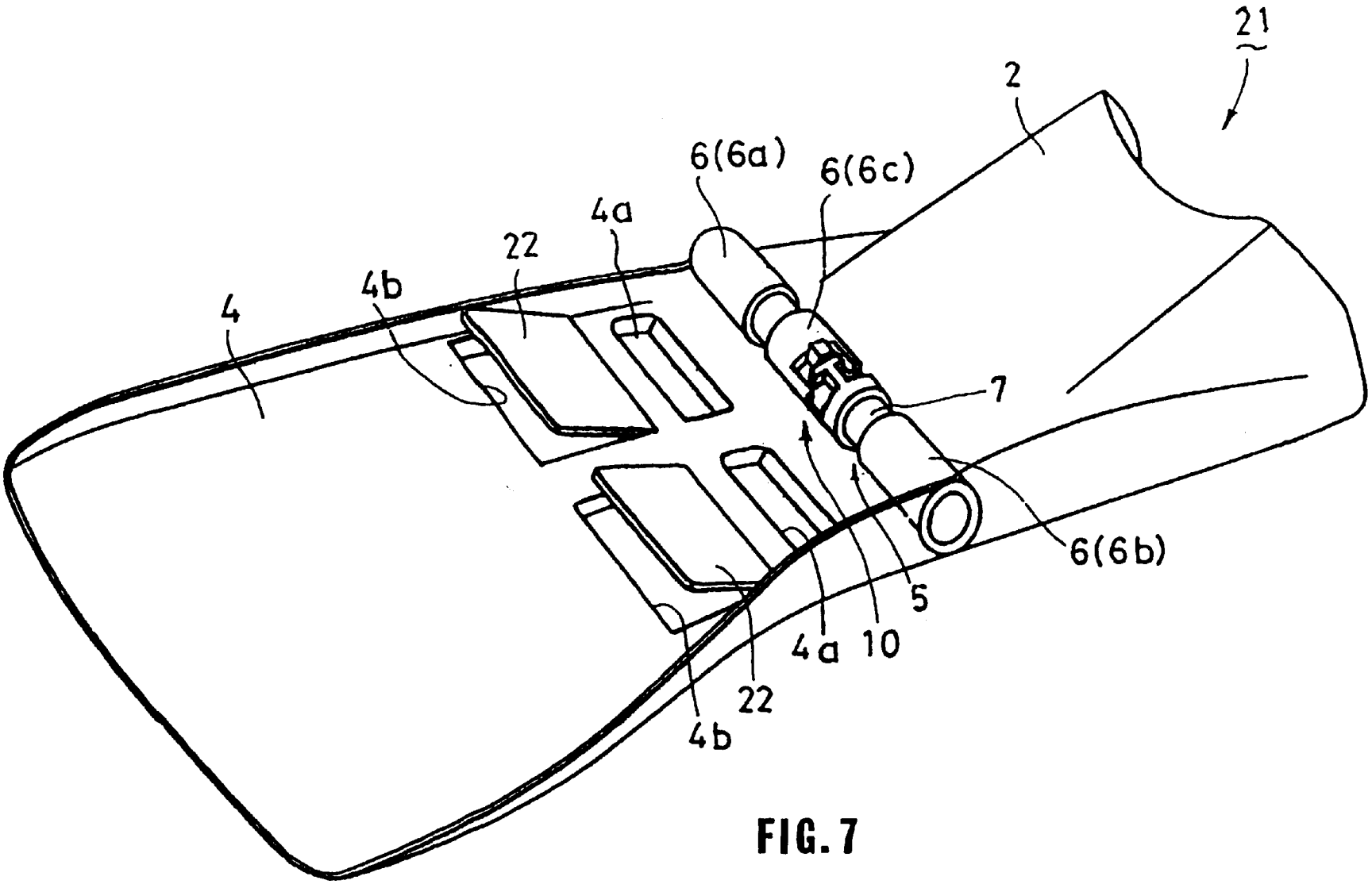

FIG. 7 is an oblique section of the diving fin in a further embodiment of the invention.

Figure 8:
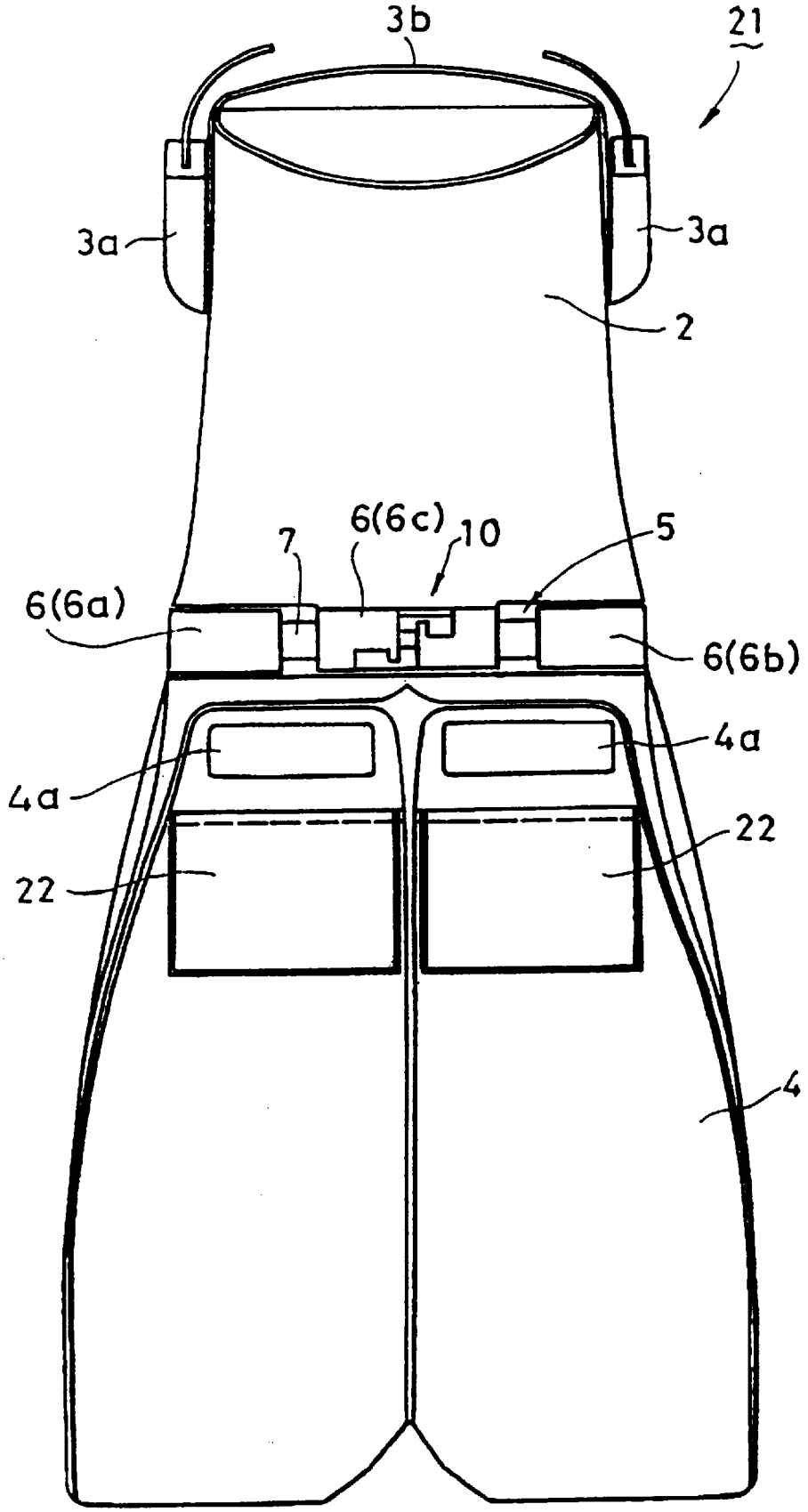

FIG. 8 is a plan view of the fin of FIG. 7.

Figure 9:
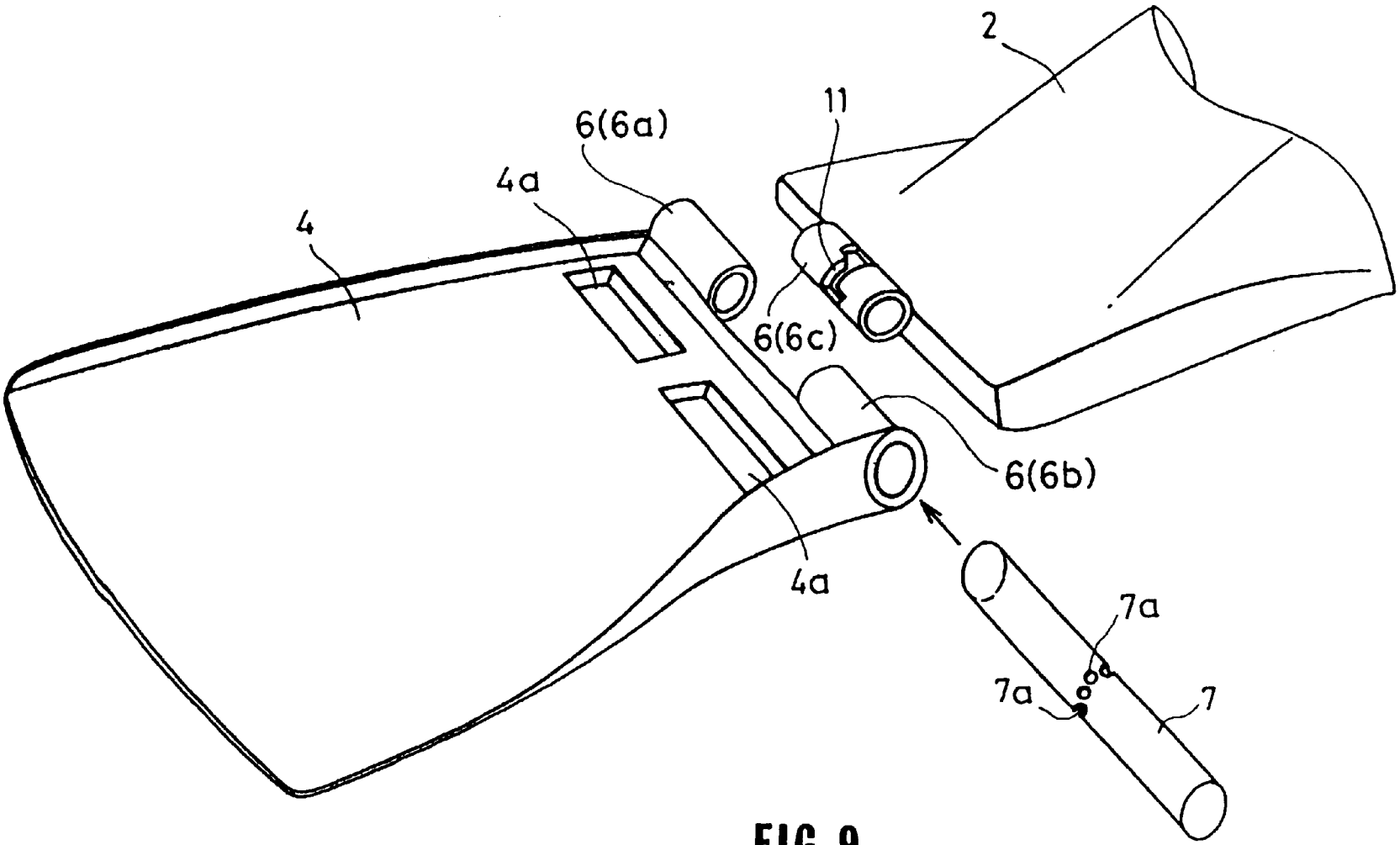

FIG. 9 is an oblique section of the disassembly of the diving fin in a still further embodiment of the invention.

Figure 10:
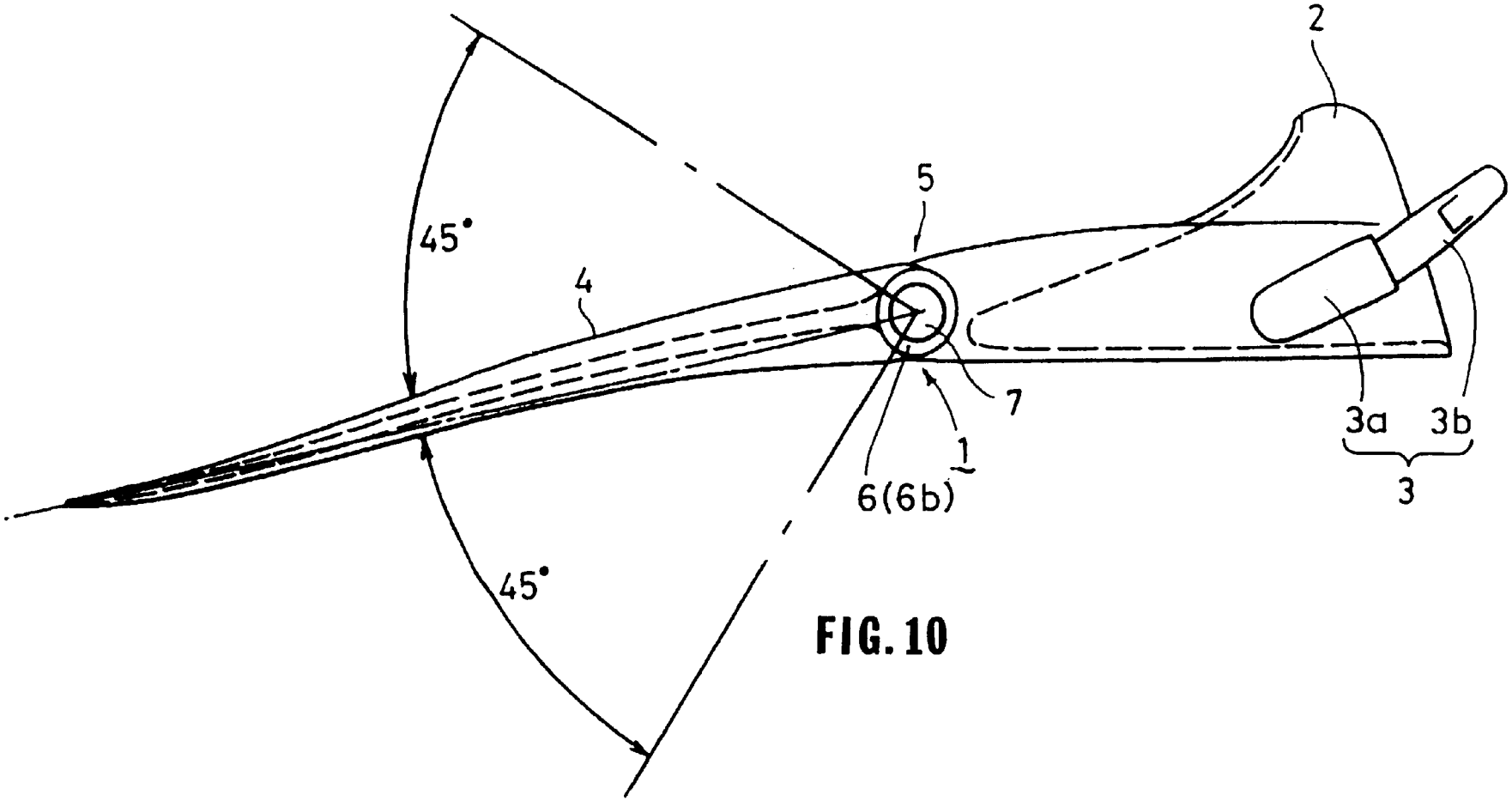

FIG. 10 is a side view of the diving fin of FIG. 9.

Figure 11A:
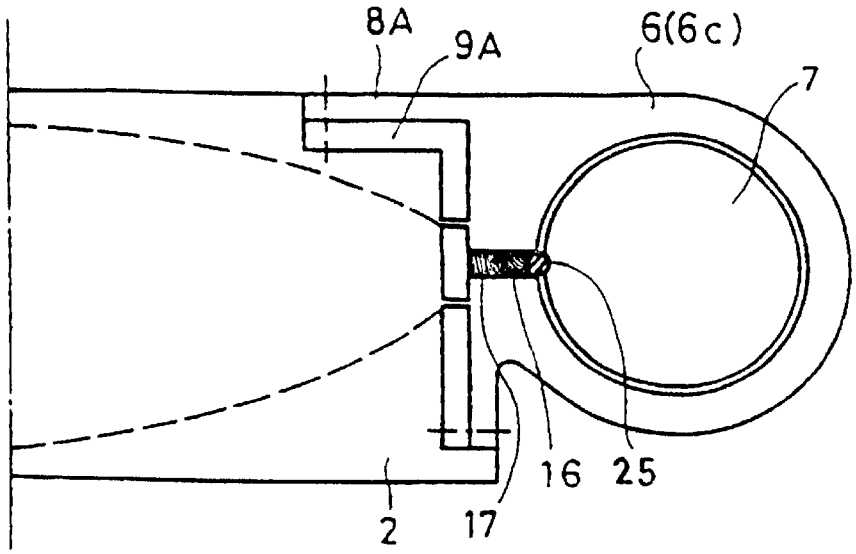
Figure 11B:
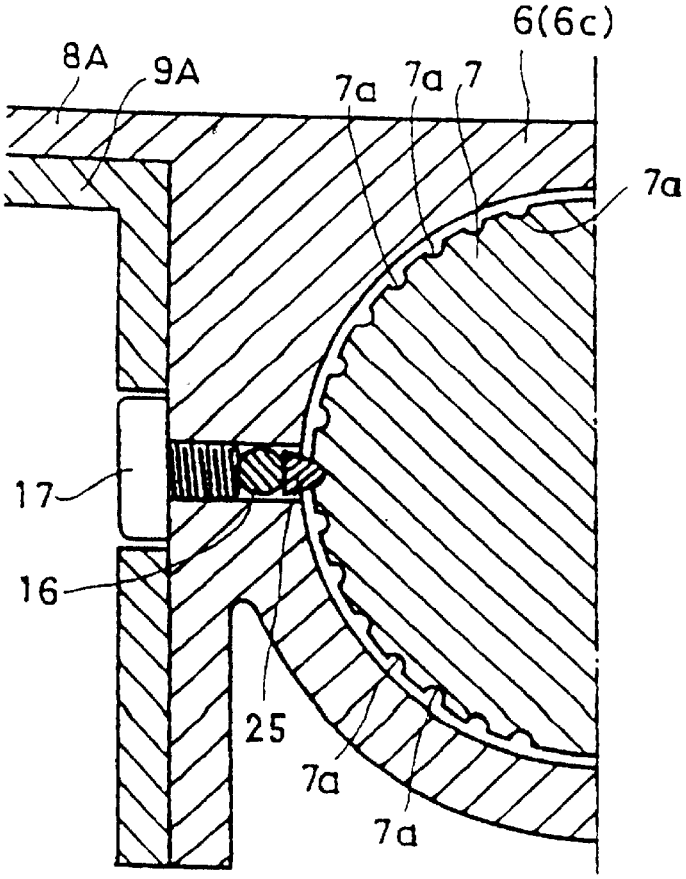

FIG. 11 shows the fixation structure at the side of the boot section of the same diving fin, and (a) of FIG. 11 is the drawing for a cross section and (b) of FIG. 11 is the drawing for a partial enlargement of (a) of FIG. 11.

Figure 12:
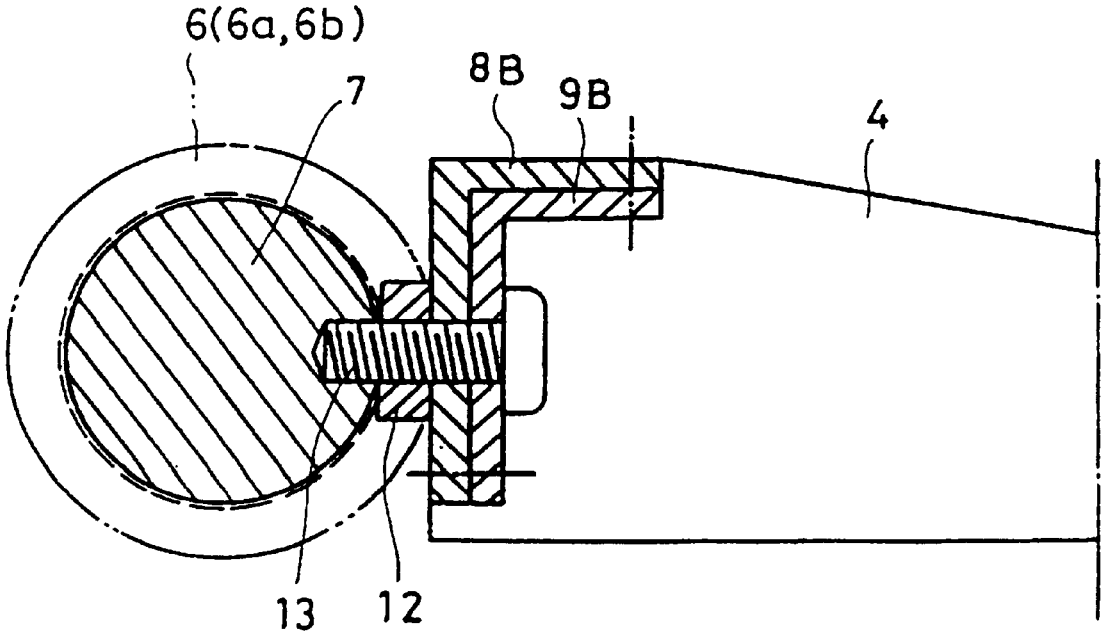

FIG. 12 is for a cross section of the fixation structure at the side of the fin section of the same diving fin.

DETAILED DESCRIPTION

The following is the detailed explanation about how to practice the invention by referring to the drawings. This explanation is made by one of the pair of the diving fins.

FIG. 1 and FIG. 6 show a first embodiment of the invention applied to the diving fins 1. In these drawings, the numeral 2 is for the boot section for the diver's foot attachment/detachment. This boot section 2 consists of the main body designed for the diver's foot placement which covers his foot line from its toe's tip to its ankle, and its heel fixation belt 3 installed in it. But the main body does not have any space designed for the heel placement. Put in another way, when the diver's foot is placed in the boot section 2, his heel is exposed outwardly, and fixed with the heel fixation belt 3.

The heel fixation belt 3 consists of the belt holding device 3*a* installed in both sides, right and left, of the main body of the boot section 2, and the belt 3*b* attached to the holding device 3*a*. The belt 3*b* is attached to the belt holding device 3*a* right and left at both ends of the belt, and laid out all around the back side of the boot section 2. The belt holding device 3*a* is designed to fix the belt 3*b* at the desired position by extending or pulling it back toward its extensible direction. Because of this mechanism, the length of the belt 3*b* is adjustable according to the size of the diver's foot.

In the forefront of the boot section 2 is installed the fin section 4 which is designed to be movable by means of the supportive structure 5. More specifically, the fin section 4 is of the plate in thin thickness, and especially formed in the fan-shape with width which is gradually bigger from its back side toward its forefront. And, at the back end side of the fin section 4, there are two vent holes 4*a* formed, which the water goes through in the direction of its thickness.

The supportive structure 5 consists of cylindrical bodies 6 placed in the forefront of the boot section 2 and at the back end of the fin section 4, and the axle 7 which is inserted into these cylindrical bodies 6.

The cylindrical bodies 6 are placed in a row in the direction of width of the diving fin 1 (hereinafter called in the sideway direction). They are three in total—6*a*, 6*b* and 6*c*. 6*a* and 6*b* placed outwardly are attached to the side of the fin section 4, and 6*c* placed in between is attached to the side of the boot section 2. There is some spacing in between the neighboring two of the cylindrical bodies 6. This spacing is fixed according to the length of the lateral displacement to be offset by the fin section 4 at the time of turning the fin section.

Insertion of the axle 7 into each of the cylindrical bodies 6 connects the boot section 2 with the fin section 4, and makes it possible for the fin section 4 to turn toward the forefront side and the back end side of the boot section 2.

Concerning the cylindrical bodies 6, it is possible to place one each in the forefront of the boot section 2 and at the back end of the fin section 4. It is also possible to place more than three cylindrical bodies, as long as the boot section 2 and the fin section 4 can be connected by insertion of the axle.

In such supportive structure 5 as earlier mentioned, is installed the fixation or latch structure 10 for the fin section 4, the configuration of which is below described.

Figure 4:
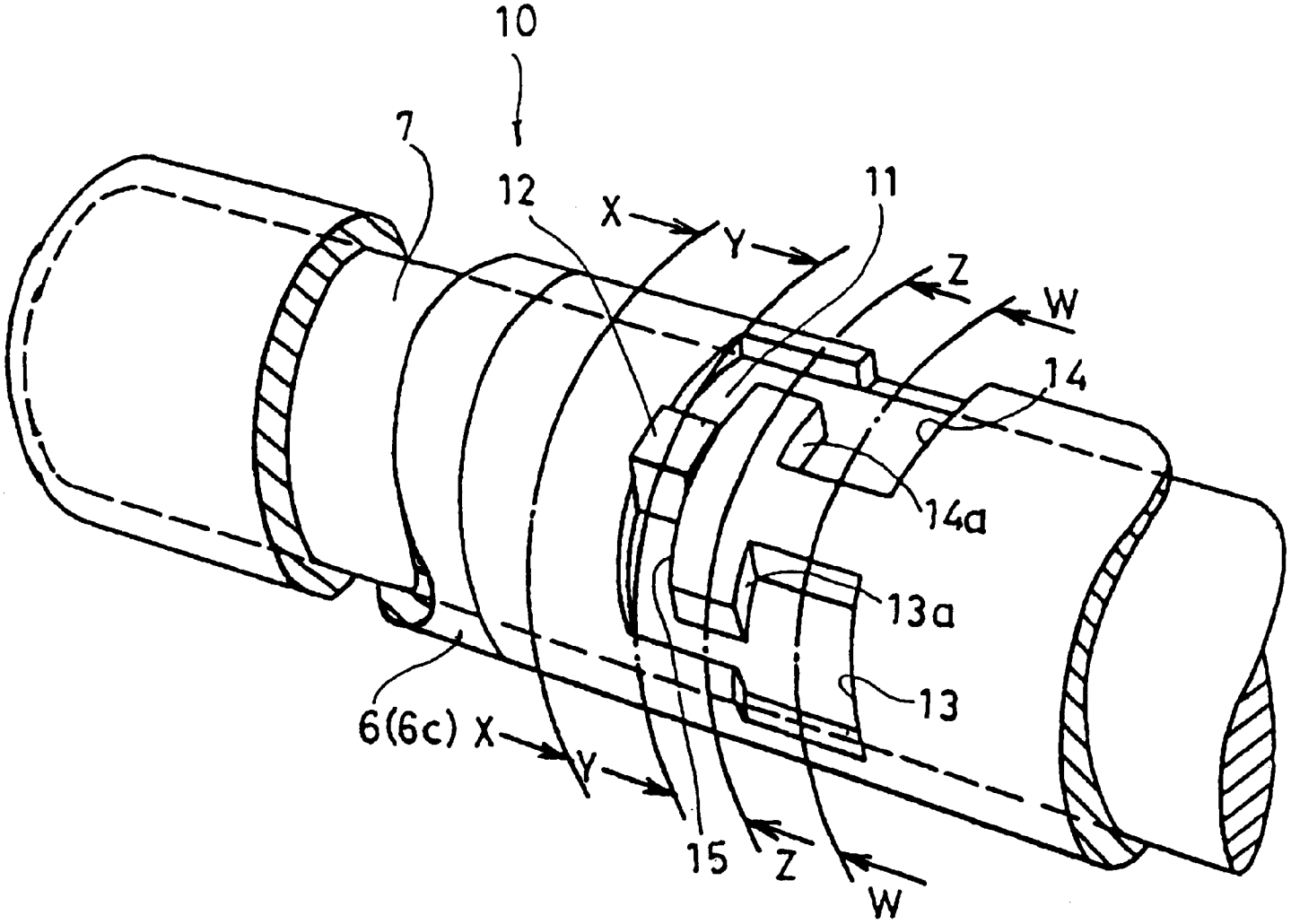
FIG. 4 is an oblique section of the fixation structure of the same diving fin.
Figure 5A:
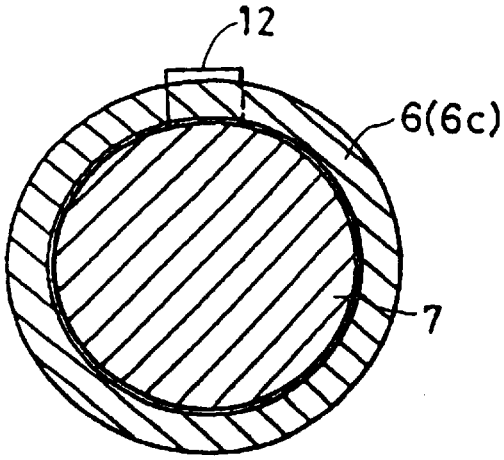
FIG. 5 is the drawing for a cross section of FIG. 4.
Figure 5B:
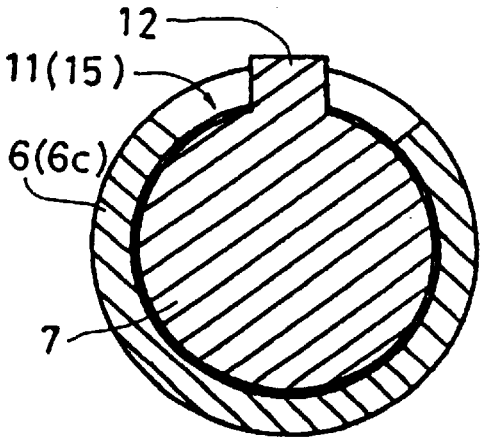
Figure 5C:
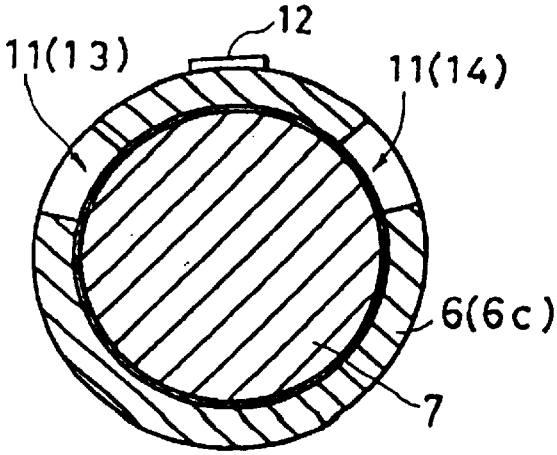
Figure 5D:
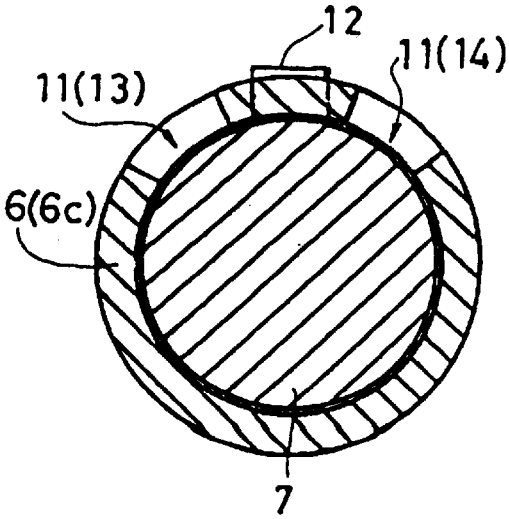

This fixation structure 10, as detailed in FIG. 4 and FIG. 5, is composed of the cut out slit 11 which goes through the exterior and the interior of the cylindrical body 6 (6*c*) placed in between in this instance, and the protrusion 12 which appears on the surface of the axle 7, is fixed there, and positioned in the interior of the cut out slit. This fixation structure 10 is installed only in the cylindrical body 6*c* positioned in the middle of the cylindrical bodies 6 in this practicing instance, but can also be installed in any of the other ones of the cylindrical bodies 6 or can also be installed in each one of the cylindrical bodies 6.

Concerning the cut out slits 11, the first cut out slit 13 and the third slit 15 are formed successively. More specifically, the first cut out slit 13 is formed in the sideway direction as earlier mentioned (toward the axle core of the cylindrical bodies 6) and is coupled with the protrusion 12 at the time the fin section 4 is put in the horizontal position extending toward the forefront of the boot section 2.

And, the second cut out slit is formed in the sideway direction as earlier mentioned (toward the axle core of the cylindrical bodies 6 and is coupled with the protrusion 12 at the time the fin section is put in the upright position against the back end side of the boot section 2. of course, the first cut out slit 13 and the second one 14 are formed separately in the direction of the circumference of the cylindrical bodies 6. In addition, the third cut out slit 15 is formed in between the first cut out slit 13 and the second cut out slit 14 in the direction of the circumference of the cylindrical bodies 6.

Each of the first cut out slit 13 and the second cut out slit 14 has its stepped sections 13*a* and 14*a* formed where the slit is cut out in bigger width. By direct contact of the protrusion 12 with these stepped sections 13*a* and 14*a*, the transition of the protrusion 12 from the first and the second cut out slits 13 and 14 to the third cut out slit 15 can be prevented.

The following is the explanation about an instance of the use of the diving fin 1 whose construction is above detailed.

The diver attaches the boot section 2 to each of his feet. In this case, the size of the belt 3*b* of the belt holding device 3 has to be adjusted according to the size of his feet in order to avoid its detachment. At the time of his walk either on the boat or on the ground before he gets ready for diving into the water, he holds the fin section by hand for instance, and couples the protrusion 12 with the second cut out slit 14 by turning the fin section with the axle 7 as the starting point toward the back end side of the boot section 2. At this moment, the fin section 4 is put in the upright position, so only the sole of the boot section 2 touches the floor of the boat or the ground surface at the time of the diver's walk.

In case of diving into the water in the above situation, the diver holds the fin section 4 once again and then disconnects the coupling of the second cut out slit 14 and the protrusion 12. While shifting the position of the protrusion 12 inside of the third cut out slit 15, he turns the fin section 4 with the axle 7 as the starting point toward the forefront side of the boot section 2, and couples the protrusion 12 with the first cut out slit 13 this time. At this moment, the fin section 4 is put in the horizontal position extending in the horizontal direction—namely in the normal position for use at the time of diving into the water.

Incidentally, at the time of position transition of the protrusion 12 from the first and the second cut out slits 13 and 14 to the third cut out slit 15, because of some spacing in between the two of the cylindrical bodies 6 (6*a*, 6*b* and 6*c*), this transition can be made smoothly by offsetting the position of the fin section 4 slightly in the sideway direction as earlier mentioned.

No matter in what position the afore-mentioned fin section 4 may be, namely either in the upright position or in the horizontal position, the coupling of the protrusion 12 with the first and the second cut out slits 13 and 14 will never be disconnected by accident. In other words, since each of the cut out slits 13 and 14 has its stepped section 13*a* or 14*a* formed where the slit is cut out in bigger width, because of the self control of the fin section 4, the protrusion 12 is shifted to either stepped section (namely, either one in bigger width in the direction of the circumference of the cylindrical bodies 6). By this shifting, the protrusion 12 touches the stepped sections 13*a* and 14*a*, so the shift in the sideway direction as earlier mentioned is prevented.

In case of the afore-mentioned cut out slit 11, the first and the second cut out slits 13 and 14 are formed against the third cut out slit 15 as a sideward U shape (see FIG. 6 (6*a*)). On the contrary, they can be formed like the Z letter shape in the same sideway direction, but at the opposite side each other (see FIG. 6 (6*b*)). However, the one shaped like the sideward U shape has the following strong point especially. That is to say, attach the diving fin 1 as shown in FIG. 1 to the left foot, and attach to the right foot the different diving fin with the fixation structure formed symmetrically against the fixation structure 10 for this diving fin 1. In this case, both of the upright position and the horizontal position of the fin section 4, the axle 7, right and left, protrudes itself outwardly in the sideway direction as earlier mentioned. For this instance, the fin section will never stand in the way at the time of walk, because the axle does not protrude itself between both feet.

In the case of the diving fin 1 related to the first embodiment of the invention, the position of the fin section 4 can be changed over by the one-touch operation from its horizontal position where the fin section 4 extends itself horizontally to its upright position where the fin section 4 stands in the upright position, depending on such cases as at the time of its use in the water or at the time of walk on the boat or the ground. Therefore, without removal of the diving fin 1 from the feet, walking from the boat or the ground till diving into the water is very easy to be done. The troublesome job involved from the water to the ladder of the boat is also eliminated.

A second embodiment of the invention is explained by referring to FIG. 7 and FIG. 8, as in the followings.

The diving fin 21 detailed in the second practicing instance of the invention is completed by additional innovation effected on the diving fin 1 detailed above in the first practicing instance of the invention. More specifically, the diving fin 21 is equipped with the cut out hole 4b made by cutting out a part of back end side of the fin section 4 of the diving fin 1, and the cut out fin or flap 22 to be coupled with this hole. And, this cut out fin is designed to turn from the forefront side to the back end side of the boot section 2. Since the diving fin 21 is same with the afore-mentioned diving fin 1 in other construction configuration, this explanation is omitted.

In the case of the diving fin 21, especially at the time of its use in the water (when the fin section 4 is in the horizontal position), the cut out fin 22 vibrates according to the movement of the diver's feet. With this vibration, the water goes through the cut out hole of the fin section 4. More specifically, when the feet are moved from the upper side to the lower side, the water goes through from the front side to the reverse side of the fin section 4. And, conversely speaking, when the feet are moved from the lower side to the upper side, the water goes through from the reverse side to the front side of the fin section 4. At this moment, of course, the water also goes through the vent hole 4*a*. For this reason, the water resistance can be further reduced at the time of its use as compared with the case the water goes only through the vent hole 4*a*. This enables the diver to get the amazing propulsion in the water.

As clearly presented through the above explanation, the diving fin of the invention in question, being designed to make the fin section turn in point of construction, enables the diver to change over the fin section from the horizontal position to the upright position by one-touch operation, on both occasions—at the time of use of the diving fin in the water at the time of walk on the boat or on the ground.

As a result, without removal of the diving fin from the feet, walking from the boat or the ground till diving into the water is very easy to be done. The troublesome job involved can therefore be eliminated. In addition, with the cut out fin installed, the water resistance at the time of its use can be further reduced and much greater propulsion can be obtained.

Furthermore, at the time the first cut out slit and the second one are put in the same direction, the axle will not stay in the way at the time of walk.

A third embodiment of the invention is explained in detail with reference to FIGS. 9–12. This explanation is made by taking up the one half of the pair of the diving fin.

As before, the supportive structure 5 consists of cylindrical bodies 6 placed in the forefront of the boot section 2 and at the back end of the fin section 4, and the axle which is inserted into these cylindrical bodies 6.

The cylindrical bodies 6 are placed in a row in the direction of the width of the diving fin 1 (hereinafter called in the sideway direction). They are three in total—6*a*, 6*b* and 6*c*. 6*a* and 6*b* placed outwardly are attached to the side of the boot section 2.

Put in more detail, the cylindrical body 6*c* is fixed to the boot section 2 as shown in FIG. 11—cross-section drawing, while the cylindrical bodies 6*a* and 6*b* are fixed to the fin section 4 as shown in FIG. 12—cross section drawing. In other words, at the forefront of the boot section 2, the cross section L shape bracket 8A with the cylindrical body 6*c* stuck to it to form one body is fixed firmly with the metal fittings by such method as bolt commonly used, while at the back end of the fin section 4, the cross section L shape bracket 8B with the cylindrical bodies 6*a* and 6*b* stuck to it to form one body is fixed firmly with the metal fittings by such method as bolt commonly used.

And, there is some spacing in between the neighboring two of the cylindrical bodies 6. This spacing is fixed according to the length of the displacement to be offset by the fin section 4 in question at the time of turning the fin section.

Insertion of the axle 7 into each of the cylindrical bodies 6 connects the boot section 2 with the fin section 4, and makes it possible for the fin section 4 to turn toward the forefront side and the back end side of the boot section 2.

Concerning the cylindrical bodies 6, it is possible to place one each in the forefront of the boot section 2 and at the back end of the fin section 4. It is also possible to place more than three cylindrical bodies, as long as the boot section 2 and the fin section 4 can be connected by insertion of the axle.

In such supportive structure 5 as earlier mentioned, is installed a fixation structure 10' for the fin section 4, the configuration of which is below described.

In this instance, on the cylindrical body 6*c* positioned in the middle, the cut out slit 11 going through the front to the reverse side of it is formed as shown in FIG. 9. And, as shown in FIG. 12, in such condition where the protrusion 12 is positioned in this cut out slit 11, the vise is screwed in from the fin section 4 until it reaches the axle inserted into each of the cylindrical bodies 6. At this moment, the axle 7 and the fin section 4 are fixed in one piece via the protrusion 12 in point of the construction. Because of this construction, the axle is designed to turn in the direction of the circumference to the accompaniment of the fin section's turning like one piece movement.

On the other hand, at the side of the boot section 2, is formed the hole 14 which goes through the afore-mentioned cylindrical body 6*c*, bracket 8A and metal fittings 9A. In this hole 14, from the side of the cylindrical body 6*c* to the side of the boot section 2, in due order, are inserted the protruding body 15, the silicon spacer 16 and the bolt 17. Put in further detail, the bolt 17 is screwed into the afore-mentioned hole 14 from the inside of the boot section 2. And the protruding body 25 is positioned at the forefront of this bolt 17 via the elastic silicon spacer 16. This protruding body 25 is made to contact the surface of the axle 7 at its front end, and whether it goes in or out depends upon the elasticity of the silicon spacer 16. On the axle 7, there are plural punched out connecting holes 7*a* to be coupled with the protruding body 25. These connecting holes 7*a* are made at the equal distance interval in the direction of the circumference of the axle 7, and with the cut out edge.

These connecting holes 7*a* are made in relation to the turning angle of the fin section 4 against the boot section 2. Put differently, under this condition, the fin section 4 is designed to turn between at the upright position where it stands upright against the back end side of the boot section and at the bended position where it turns to bend toward the reverse side of the boot section 2. At both positions, the afore-mentioned fin section 4 is in the horizontal position extending toward the forefront of the afore-mentioned boot section 2. In both directions, the afore-mentioned fin section 4 is designed to be set up to the maximum of 45 degrees by 5-degree increments.

By connection of the protruding body 25 to the connecting holes 7*a* at each set up position based on 5-degree increments, the fin section is fixed firmly to the boot section 2 at the designated angle. Conversely, as the fin section 4 turns, the protruding body goes in because of the elasticity of the silicon spacer and this activates the release of the connection which makes the fin section 4 start to turn.

At the time of walking on the boat or the ground until diving into the water, hold the fin section 4 by hand and turn it from the axle as the starting point toward the back end side of the boot section 2. At this moment, the fin section is put into the upright position, so it is only the boot sole that touches the surface on the boat or on the ground.

Here in the fixation structure 10', accompanying the turning of the fin section 4 by hand, connection of the protruding body 25 with the connecting hole 7*a* of the axle 7 as well as release of this connection is made. The connecting holes 7*a* are formed in compliance with the folded angle of the fin section against the boot section 2, and the folded angle covers 45 degrees as the maximum by 5-degree increments. This folded angle is set as 5 degrees at the time the fin section 4 is connected to the first connecting hole 7 from the horizontal position, and as 10 degrees at the time it is connected to the second connecting hole 7*a*. In such manner, the folded angle is set up at 5 degree increments. At the time of such connection as earlier mentioned, because of elasticity of the silicon spacer 16, protruding body 25 is pushed outwardly from the hole 14. At the time of the disconnection, to the contrary the protruding body 25 is put into the interior of the hole 14 because of compression of the silicon spacer 16.

In case the diving is made in such situation as above mentioned, hold the fin section 4 once again and turn it toward the reverse side of the boot section 2 from the axle as the starting point. On this occasion also, accompanying the turning of the fin section 4 by hand, like the above-mentioned case, the connection of the protruding body 25 with the connection hole 7*a* of the axle 7 as well as the release of this connection is made. The folded angle is set as 5 degrees at the time of the connection of the fin section 4 to the first connecting hole 7, and as 10 degrees at the time of its connection to the second connecting hole 7*a*, but at the opposite side to that in the above-mentioned case from the horizontal position of the fin section 4. In such manner, the folded angle is set up at 5 degree increments.

As explained earlier, at the time of the use of the fin section 4 at the designated angle from its horizontal position by turning it toward the reverse side of the boot section 2, the load to the foot movement in the water can be reduced as compared with the case it is used at its horizontal position. In addition, since the folded angle of the fin section 4 against the boot section 2 can be set up at 5 degree increments, this assures the diver of the versatility in setting his desired angle according to the strength of his foot and his diving purpose. This operation can also be made quite easily just by turning the fin section by hand.

In case of exchange of the shape of the fin section 4 for the different one or conversely in case of exchange of the size of the boot section 2 for the bigger one or vice versa, follow the following procedures. Unscrew the vise 13 with the screw driver or something and the connection of the fin section 4, the axle 7 and the protrusion 12 is released, and especially the axle 7 inserted into the interior of the cylindrical bodies 6 is disconnected. On the other hand, a various shapes of the boot section 2 and the fin section 4 are to be prepared as options. After the exchange of these for other ones, insert the axle 7 into each of the cylindrical bodies 6 once again and connect the fin section 4, the axle 7 and the protrusion 12 firmly with the vise like the one piece body. In this fashion, the diving in question can be used with a variety of combinations of the boot section 2 and the fin section 4—namely in different sizes according to the preference of each diver. Besides, the jobs involved for this exchange are extremely simple and easy.

As clearly presented through the above explanation, the diving fin is designed to make it possible for the fin section to turn toward the back side of the boot section and to fix it at the designated angle. This reduces the load to the diver's foot at the time of its use in the water, and meets with the convenience and the preference of each individual diver. In addition, since the boot section and the fin section are attachable and detachable in point of the construction, easy exchange of these sections for other ones according to the diver's preference can be considered as one of the benefits are expected from this diving fin.

We claim:

1. A diving fin comprising a boot section for foot attachment and detachment and a fin section installed in the forefront of the boot section by a supportive structure, the fin section being turnable relative to the boot section by means of the supportive structure between a horizontal position extending forwardly from the boot section and an upright position, the supportive structure comprising a latch means for detachably fixing the fin section in the horizontal position and the upright position, the supportive structure comprising axially aligned cylindrical bodies at the forefront of the boot section and at the rear end of the fin section, the supportive structure further comprising a shaft through the cylindrical bodies and supporting the fin section for turning relative to the boot section, and a pair of adjacent ends of the cylindrical bodies are laterally spaced apart.

2. A diving fin as in claim 1 in which:

the latch means comprises a slit formed in one of the cylindrical bodies that receives a protrusion projecting radially from the shaft, the slit having a circumferentially oriented portion and a pair of axially oriented portions at opposite ends of the circumferentially oriented portion, the protrusion being coupled with a first one of the axially extending slits when the fin is in the horizontal position and being coupled with a second one of the axially extending slits when the fin is in the upright position, the circumferentially oriented slit portion providing a passage for transition of the protrusion between the first and second of the axially extending slits.

3. A diving fin as in claim 2 in which:

the first and second axially oriented slits comprise stepped sections.

4. A diving fin as in claim 2 in which:

the first and second axially extending slits project in the same direction from the circumferentially oriented slit.

5. A diving fin as in claim 2 which:

the first and second axially oriented slits extend in opposite directions from the circumferentially oriented slit portion.

6. A diving fin comprising a boot section and a fin section installed at the forefront of the boot section by a supportive structure, the supportive structure comprising a cylindrical sleeve rotatably receiving a shaft by means of which the fin section is turnable relative to the boot section, the shaft having a series of circumferentially oriented and arcuately spaced apart depressions, one of the boot section or fin section mounting a protrusion element that is resiliently biased towards engagement with the depressions of the shaft.

7. A diving fin as in claim 6 in which the circumferential extent of the depressions is sufficient to permit turning of the fin section both upwardly and downwardly relative to the plane of a sole of the boot section.

8. A diving fin as in claim 6 in which the depressions of the shaft are arcuately spaced apart in five degree increments.

* * * * *